US009232819B2

(12) United States Patent
Damiani et al.

(10) Patent No.: US 9,232,819 B2
(45) Date of Patent: Jan. 12, 2016

(54) LIGHTING APPARATUS FOR TOBACCO-BASED PRODUCTS

(71) Applicants: Teresa R Damiani, Hinckley, OH (US); Bruce A Zaccagnini, Brunswick, OH (US); James Cutri, Alexandria, VA (US)

(72) Inventors: Teresa R Damiani, Hinckley, OH (US); Bruce A Zaccagnini, Brunswick, OH (US); James Cutri, Alexandria, VA (US)

( * ) Notice: Subject to any disclaimer, the term of this patent is extended or adjusted under 35 U.S.C. 154(b) by 176 days.

(21) Appl. No.: 13/804,378

(22) Filed: Mar. 14, 2013

(65) Prior Publication Data

US 2014/0262856 A1 Sep. 18, 2014

(51) Int. Cl.

| | |
|---|---|
| ***A24F 15/18*** | (2006.01) |
| ***A24D 1/08*** | (2006.01) |
| ***F23Q 1/06*** | (2006.01) |
| ***A24F 15/10*** | (2006.01) |

(52) U.S. Cl.
CPC . *A24D 1/08* (2013.01); *A24F 15/10* (2013.01); *A24F 15/18* (2013.01); *F23Q 1/06* (2013.01)

(58) Field of Classification Search
CPC ..... A24F 15/10; A24F 15/18; A24F 13/24; A24D 1/08
USPC ..... 206/85–95
See application file for complete search history.

(56) References Cited

U.S. PATENT DOCUMENTS

| | | | | |
|---|---|---|---|---|
| 1,529,181 | A | | 3/1925 | Holmes |
| 1,835,928 | A | | 12/1931 | Boillot |
| 1,971,203 | A | | 8/1934 | Soltys |
| 2,006,591 | A | | 7/1935 | Fox |
| 2,445,317 | A | * | 7/1948 | Montague ..... 206/107 |
| 2,652,060 | A | * | 9/1953 | Cheng ..... 131/351 |
| 2,803,376 | A | | 8/1957 | Kampff |
| 2,997,045 | A | | 8/1961 | Karapff |
| 3,046,995 | A | | 7/1962 | Christy |
| 3,136,318 | A | | 6/1964 | Nakamura |
| 3,359,987 | A | | 12/1967 | Ishii |
| 4,164,999 | A | | 8/1979 | Tsukamoto |
| 4,310,007 | A | | 1/1982 | Auersbacher |
| 4,342,902 | A | | 8/1982 | Ping |

(Continued)

FOREIGN PATENT DOCUMENTS

| | | | |
|---|---|---|---|
| JP | 11-178563 | A | 7/1999 |
| JP | 2012-097968 | A | 5/2012 |
| KR | 20-0272745 | Y1 | 4/2002 |

OTHER PUBLICATIONS

International Search Report and Written Opinion of International Application No. PCT/US2014/019208 mailed Jun. 2, 2014 (7 pages).

*Primary Examiner* — Richard Crispino
*Assistant Examiner* — Eric Yaary
(74) *Attorney, Agent, or Firm* — Taft Stettinius & Hollister LLP; Ryan O. White

(57) ABSTRACT

An igniter apparatus for igniting a tobacco-based product having a sensitized tip, comprising: a first portion having a first surface and a second portion having a second surface, at least one of the first and second surfaces being movable with respect to other surface, wherein at least a portion of the first and second surfaces are substantially parallel to one another; a channel at least partially formed between the first and second portions, the channel having at least one opening configured to receive the tobacco-based product as it is inserted therein; and an abrasive material coated on at least a portion of the channel, the abrasive material being configured to at least partially contact the tobacco-based product when the first and second surfaces are manually positioned a predetermined distance from one another.

20 Claims, 11 Drawing Sheets

(56) References Cited

U.S. PATENT DOCUMENTS

| | | | | |
|---|---|---|---|---|
| 4,491,139 | A | 1/1985 | Weinert | |
| 4,570,645 | A * | 2/1986 | Newman et al. | 131/175 |
| 4,621,649 | A | 11/1986 | Osterrath | |
| 4,694,841 | A | 9/1987 | Eparza | |
| 4,795,027 | A * | 1/1989 | Benavides | 206/106 |
| 2003/0205487 | A1 * | 11/2003 | Lin | 206/86 |
| 2007/0228059 | A1 * | 10/2007 | Karsan | 220/824 |
| 2007/0272566 | A1 * | 11/2007 | Divers | 206/94 |
| 2010/0264157 | A1 * | 10/2010 | Bailey et al. | 221/1 |

* cited by examiner

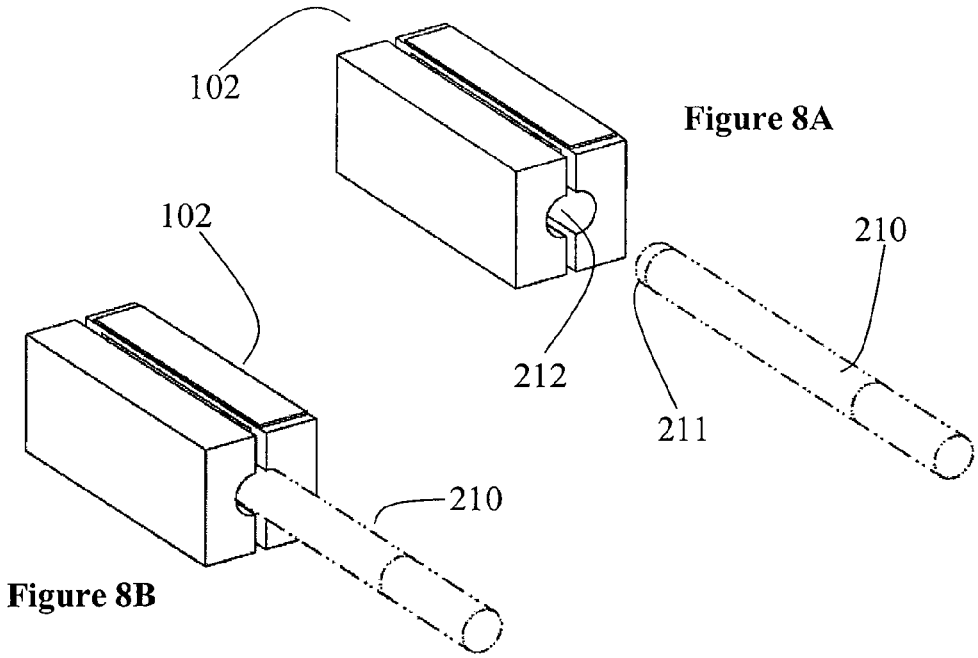
Figure 8A
Figure 8B
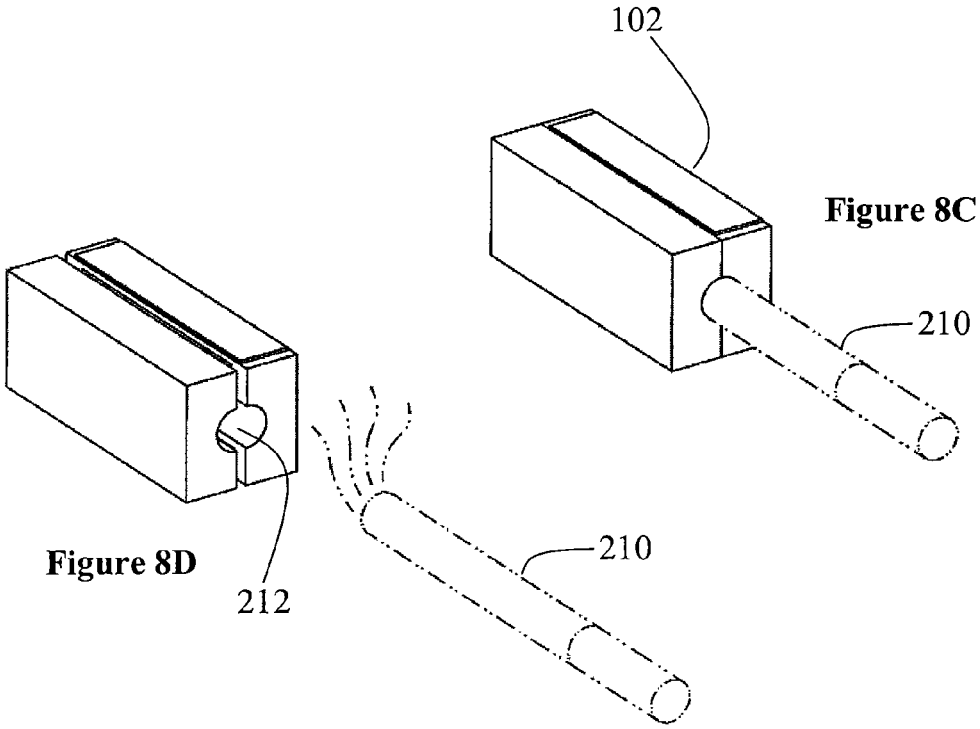
Figure 8C
Figure 8D

LIGHTING APPARATUS FOR TOBACCO-BASED PRODUCTS

TECHNICAL FIELD

The present disclosure deals with a lighting apparatus and more particularly a lighting apparatus used to ignite tobacco-based products with a sensitized tip.

BACKGROUND OF THE DISCLOSURE

The statements in this section merely provide background information related to the present disclosure and should not be construed as constituting prior art.

The production of tobacco-based products (cigarettes) has become a major industry with many consumers routinely purchasing and consuming these products. Tobacco products require an ignition source for the consumer to effectively smoke the tobacco-based contents. Consumers currently use many different methods for lighting these products. Gas lighters, electrical lighters, and matches are all commonly used as methods for igniting the tobacco within these products. The large consumer base for tobacco-based products has necessarily generated a large consumer base for the ignition sources as well.

There are several flaws in current ignition sources. The gas lighter is often made of plastic or metal and must maintain the appropriate amount of fuel to be effective. Gas lighters often do not maintain the appropriate flame when used in windy or rainy conditions. Once the fuel runs out, the lighter has to be either discarded or refilled. The gas lighter also requires significant vital resources to produce and to operate. Further, the use and disposal of the lighter creates significant negative impacts upon the environment.

Using a match as an ignition source for tobacco-based products has many undesirable effects as well. Matches are sensitive to the surrounding environment, and often cannot be used if the matches are wet or used in a windy area. The user is also limited to a set number of matches, and once the last match is used, the user will have no ignition means for lighting the tobacco-based products.

Electronic lighters can be very effective, and reusable, but usually require a bulky battery or frequent recharge to generate enough energy to ignite tobacco. The electronic lighters can also be adversely affected by water. Further, improper disposal of a portable electronic lighter can introduce harmful battery acid into the environment.

The users of tobacco based products are inconvenienced and potentially endangered by relying upon these separate ignition sources. Lighters and matches can be maintained in a relatively small compartment that can be easily lost or misplaced. Further, the misuse of these products is inherently dangerous for the consumer. Misused ignition sources frequently cause accidental fires. The propensity of matches and lighters to be misplaced significantly increases the chances that a minor will obtain and negligently misuse the product possibly resulting in severe harm.

Finally, tobacco-based products can be manufactured with a sensitized tip that allows ignition by striking against an abrasive material. This uniquely couples the ignition source to the tobacco itself. Past designs utilize strike pads on the side of a pack holding the tobacco-based product. Similar to lighting a match, the sensitized tip is dragged down the strike pad to create enough friction to ignite the tip. Lighting the tobacco-based product by striking it against the strike pad creates difficulties because the product can easily be broken when attempting to ignite the tip and the strike pad can lose the abrasive qualities necessary to ignite the tip.

What is needed is an improved design for facilitating the lighting of a tobacco-based product. The present application is intended to improve upon and resolve some of these known deficiencies of the art.

SUMMARY OF THE DISCLOSURE

In accordance with one aspect of the present disclosure, an igniter apparatus for igniting a tobacco-based product having a sensitized tip is provided. In accordance with this aspect, the igniter apparatus comprises a first portion having a first surface and a second portion having a second surface, at least one of the first and second surfaces being movable with respect to the other surface. At least a portion of the first and second surfaces are substantially parallel to one another. There is a channel at least partially formed between the first and second portions, the channel having at least one opening configured to receive the tobacco-based product as it is inserted therein. Further the channel has an abrasive material coated on at least a portion of the channel, the abrasive material being configured to at least partially contact the tobacco-based product when the first and second surfaces are manually positioned a predetermined distance from one another.

According to another aspect of the present disclosure, a kit comprising a tobacco-based product having a sensitized tip is provided. In accordance with this embodiment, the kit comprises a container for holding the tobacco-based product therein and an igniter apparatus configured to ignite the sensitized tip of the tobacco-based product. The igniter apparatus comprises a first portion having a first surface and a second portion having a second surface, and at least one of the first and second surfaces being movable with respect to other surface. At least a portion of the first and second surfaces are substantially parallel to one another. Further, there is a channel at least partially formed between the first and second portions. The channel has at least one opening configured to receive the tobacco-based product as it is inserted therein. An abrasive material is coated on at least a portion of the channel. The abrasive material is configured to at least partially contact the tobacco-based product when the first and second surfaces are manually positioned a predetermined distance from one another

BRIEF DESCRIPTION OF THE DRAWINGS

The above-mentioned aspects of the present application and the manner of obtaining them will become more apparent and the teachings of the present application itself will be better understood by reference to the following description of the embodiments of the present application taken in conjunction with the accompanying drawings, wherein:

FIGS. 8A, 8B, 8C, and 8D represent the illustrated phases of the igniter apparatus of FIG. 6 as a cigarette is inserted and ignited in accordance with the teachings of the present disclosure.

Figure 1:
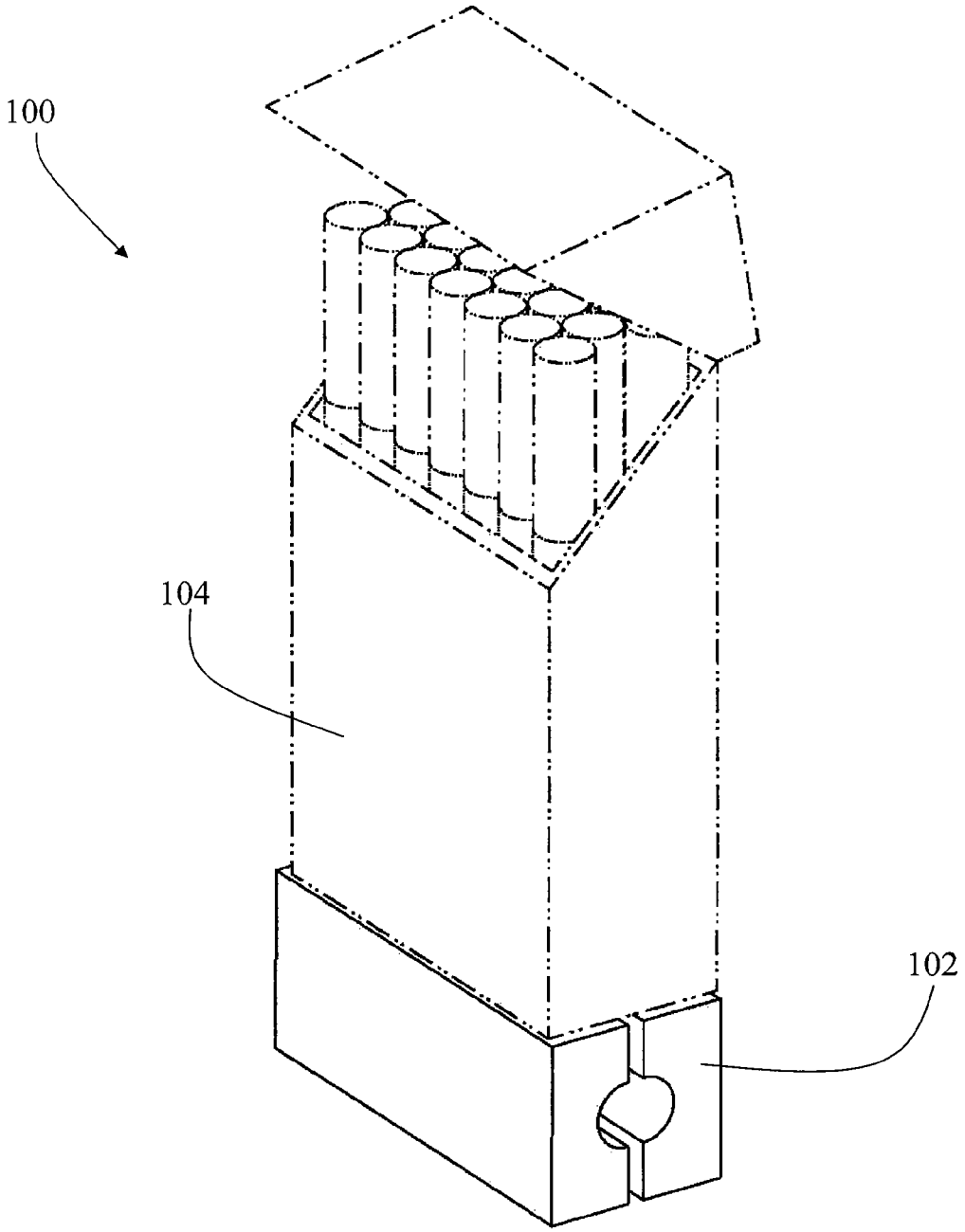
FIG. 1 represents a perspective view of an illustrative igniter apparatus coupled to a pack of cigarettes in accordance with the teachings of the present disclosure.

Corresponding reference characters indicate corresponding parts throughout the several views. Although the exemplification set out herein illustrates embodiments of the present application, in several forms, the embodiments disclosed below are not intended to be exhaustive or to be construed as limiting the scope of the present application to the precise forms disclosed.

DETAILED DESCRIPTION

The embodiments of the present application described below are not intended to be exhaustive or to limit the teachings of the present application to the precise forms disclosed in the following detailed description. Rather, the embodiments are chosen and described so that others skilled in the art may appreciate and understand the principles and practices of the present application.

Unless defined otherwise, all technical and scientific terms used herein have the same meaning as commonly understood by one of ordinary skill in the art to which this application belongs. To this end, the phrase "tobacco-based product" is intended to include any tobacco product or similar product capable of igniting in accordance with the teachings of the present disclosure. This includes, but is not limited to, cigarettes and cigars. As such, those of skill in the art should understand and appreciate herein that the present teachings are intended to cover any such use of a tobacco-based product. Further, the contents of the product should not be limited to tobacco. One skilled in the art can appreciate how the disclosure herein could be used to ignite any product that is used similarly to tobacco. Although any method and materials similar or equivalent to those described herein can be used in the practice or testing of the present application, the specific methods and materials are now described.

FIG. 1 illustrates one illustrative embodiment where a pack of cigarettes 104 can be coupled to an igniter apparatus 102 to create one kit or unit 100. In accordance with certain aspects, the top of the igniter apparatus 102 can be dimensioned so that it is substantially similar to the bottom dimensions of the pack of cigarettes 104. This arrangement can allow the unit 100 to be easily transported. Coupling the pack of cigarettes 104 with the igniter apparatus 102 may give a means for storage of a sensitized cigarette (not shown) while simultaneously providing an igniter apparatus 102. While this particular embodiment shows the igniter apparatus 102 coupled to the bottom of a pack of cigarettes 104, the disclosure should not limit the igniter apparatus 102 to such an application. One skilled in the art can understand how the igniter apparatus 102 can be equally effective standing alone or coupled to a variety of surfaces. Further, one skilled in the art can understand that the pack of cigarettes could be replaced by a reusable and/or refillable container that is configured to hold a tobacco-based product therein.

Figure 2:
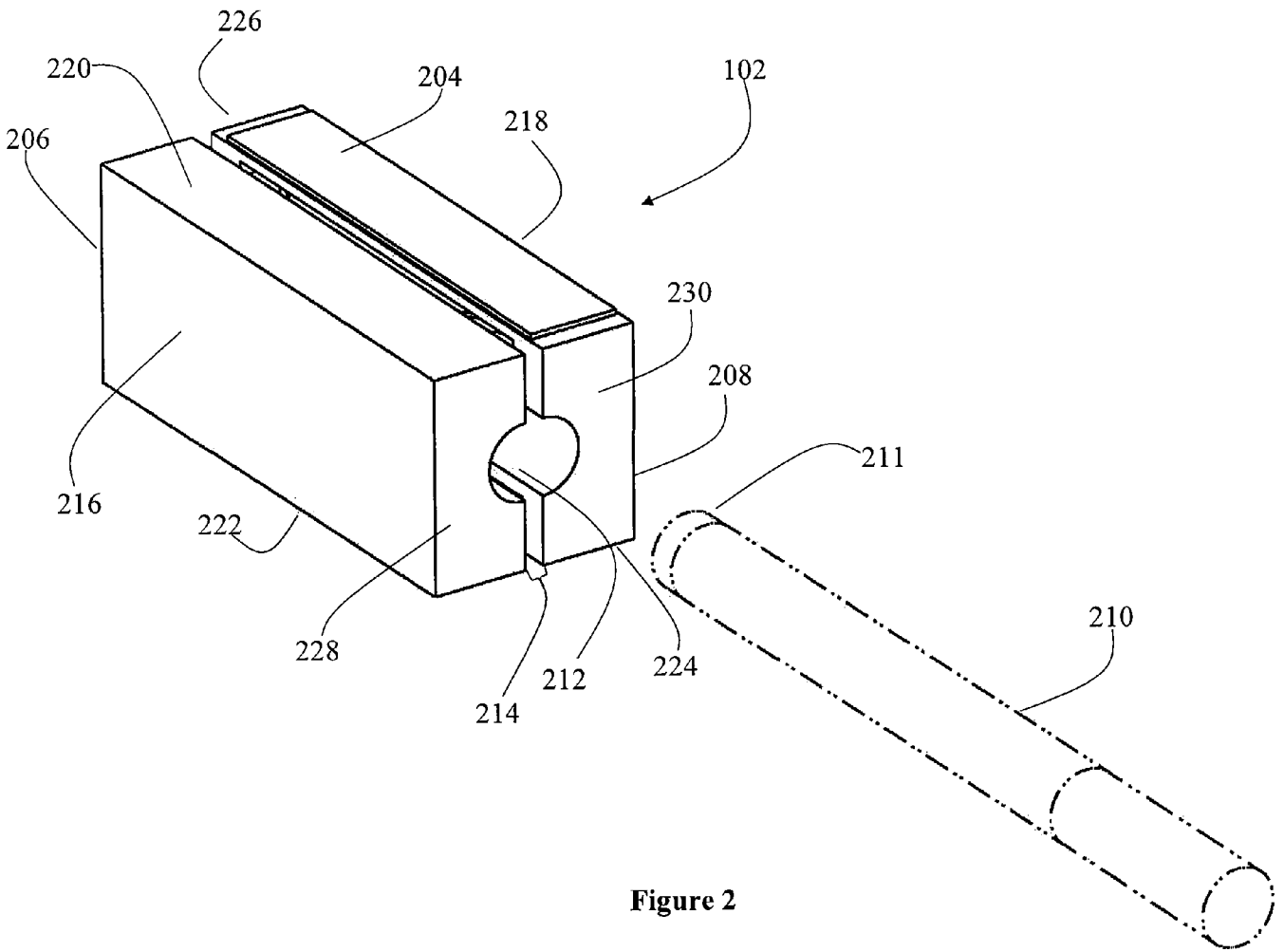
FIG. 2 represents a perspective view of the illustrative igniter apparatus of FIG. 1 in the open orientation and uncoupled from the pack of cigarettes.

FIG. 2 illustrates the igniter apparatus 102 uncoupled from the pack of cigarettes 104. In accordance with this illustrative aspect, an adhesive strip 204 may be located on an exterior surface of a first portion 206 and/or a second portion 208 of the lighter assembly 102. The adhesive strip may be formed from a plurality of different adhesive materials, including, but not limited to hook and loop fasteners, magnets, double-sided tape and the like. Further, while this particular embodiment illustrates the adhesive strip 204 on a top surface 226 of the second portion 208, the skilled artisan can understand that the adhesive strip 204 can be placed on any one or more surfaces without straying from the present disclosure. For example, the adhesive strip 204 could be located on a first side surface 216, a first bottom surface 222, a first top surface 220, a second side surface 218, or a second bottom surface 224. Further, the igniter apparatus 102 can stand alone and be stored separate from the pack of cigarettes 104 if desired.

The first portion 206 and second portion 208 of the lighter assembly 102 may be coupled in a manner that allows the two portions to be moveable relative to one another. In accordance with this aspect, the first side surface 216 and the second side surface 218 can maintain a substantially parallel planar orientation while a substantially coplanar orientation may be maintained between the first top surface 220 and the second top surface 226. Further, a coplanar orientation may be maintained between a first end surface 228 and a second end surface 230. For example, the first portion 206 and second portion 208 may be moveable closer to one another without substantially twisting or moving in any other direction.

The first portion 206 and second portion 208 can be constructed of any material sufficient to achieve the disclosed function. Such materials as plastic, metal, wood and the like should be considered incorporated herein. One skilled in the art can appreciate, without resorting to undue experimentation, that any such materials and compositions could be used to construct the disclosed embodiments. As such, the present teachings are not intended to be limited herein.

When an external force is applied to bring the first portion 206 and the second portion 208 towards one another, the gap 214 between the first portion 206 and the second portion 208 may be significantly reduced. When the gap 214 between the first portion 206 and the second portion 208 is significantly reduced, a chamber (channel) 212 may be created between the first portion 206 and the second portion 208.

A plurality of shapes could be used to create the chamber 212 as long as sufficient contact is allowed between some part of the chamber walls and the cigarette tip. The chamber could utilize many shapes such as a square, oval, triangle, octagon, and the like to achieve similar results. Further this embodiment should not be limited to enclosed chambers. For example, the chamber disclosed does not have to be entirely enclosed around the perimeter. The chamber could have a substantial gap between each half and still have sufficient contact with the cigarette tip to be effective.

While the chamber 212 can be shaped in any manner that permits a cigarette 210 to be inserted therein, in accordance with certain aspects, the chamber 212 has a substantially cylindrical shape. In accordance with this aspect of the present disclosure, the chamber 212 may have a diameter slightly greater than the diameter of a cigarette 210. Further, when there is no force exerted to bring the first portion 206 and the second portion 208 together, the gap 214 may separate the chamber 212. The gap 214 may allow a cigarette 210 with a sensitized tip 211 to be inserted or removed from the chamber 212 with minimal or no contact to the walls of the chamber 212.

Figure 3A:
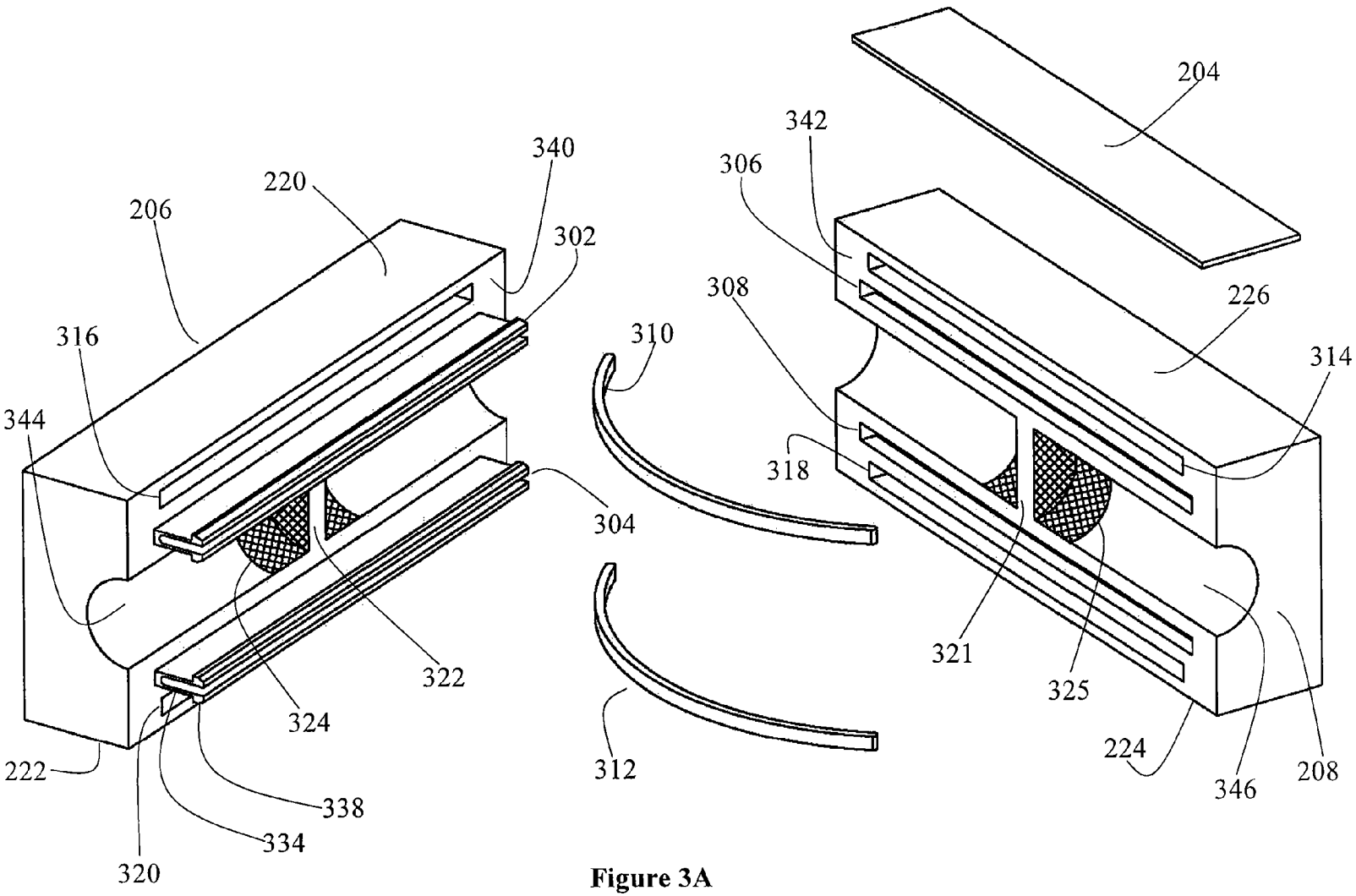
FIG. 3A represents an exploded view of the illustrative igniter apparatus of FIG. 1.

FIG. 3A is an exploded view of the igniter apparatus 102 that particularly shows the chamber 212 from FIG. 2 in its separate components. A first semicircular channel 344 on the first portion 206 and a second semicircular channel 346 on the second portion 208 can be oppositely oriented to create the chamber 212 shown in FIG. 2. The first semicircular channel 344 may have a first divider 322 located centrally along the horizontal length of the first portion 206. Further, the second semicircular channel 346 may have a second divider 321 located centrally along the horizontal length of the second portion 208. The first divider 322 can substantially fill the first semicircular channel 344 to the first planar inner surface 340. The second divider 321 can substantially fill the second semicircular channel 346 to the second planar inner surface 342. When the igniter apparatus 102 is in a standalone assembly as shown in FIG. 2, the first divider 322 and the second divider 321 align with one another to create a uniform stop surface for a cigarette 210 with a sensitized tip 211 that is inserted within the chamber 212.

It should be understood and appreciated herein that the thickness of the first divider 322 and the second divider 321 only requires enough structural integrity to resist the pressures applied by an inserted cigarette. In the present embodiment, the first divider 322 may substantially block the first semicircular channel 344 and the second divider 321 may substantially block the second semicircular channel 346. One skilled in the art can understand how a plurality of methods could be used to restrict a cigarette from being inserted past a desired point (e.g. a midpoint) of the channel. Such methods as a boss, an inward radial extrusion, and the like may be considered as incorporated herein. Further, the skilled artisan could understand that a central stop may not be necessary for the use of the cigarette igniter apparatus.

The first semicircular channel 344 may have an abrasive coating 324 located around the first divider 322 and the second semicircular channel 346 may have an abrasive coating 325 located around the second divider 321. In one aspect of the disclosure, the abrasive coating may be composed of red phosphorus, powdered glass, and an adhesive in order to sufficiently ignite the sensitized tip of the cigarette. One skilled in the art can understand how a plurality of materials and material combinations could be used as the abrasive coating for the igniter apparatus. The material consistency of the abrasive coating will correspond to the type of sensitized tip of the cigarette being ignited and all combinations should be considered incorporated herein.

On the first portion 206, the abrasive coating 324 can be located on the opposing walls of the first divider 322. Further, the abrasive coating 324 can be located on the wall of the first semicircular channel 344 at locations extending outwardly from both sides of the first divider 322. The abrasive coating 324 can extend sufficiently outward from the first divider 322, for example from about ⅛ inch to about 2 inches, to ensure the abrasive coating 324 will at least partially surround the tip of a cigarette 210 with a sensitized tip 211 when disposed therein.

Similarly, on the second portion 208, the abrasive coating 325 can be located on the opposing walls of the second divider 321. Further, the abrasive coating 325 can be located on the wall of the second semicircular channel 346 at locations extending outwardly from both sides of the second divider 321. The abrasive coating 325 can extend sufficiently outwardly, for example from about ⅛ inch to about 2 inches, to ensure the abrasive coating 325 will at least partially surround the tip of a cigarette 210 with a sensitized tip 211 when disposed therein.

When the first portion 206 and the second portion 208 are coupled to one another as shown in FIG. 2, the abrasive coatings 324 and 325 form a continuous surface coating that may substantially surround the chamber 212 near the first divider 322 and the second divider 321. Further, the abrasive coatings 324 and 325 may be distributed on each side of the first divider 322 and the second divider 321 to allow a cigarette 210 with a sensitized tip 211 to be ignited by inserting the cigarette 210 into either side of the chamber and withdrawing the cigarette 210 while the first portion 206 and the second portion 208 are in the substantially closed position.

The first portion 206 and the second portion 208 may also create cavities to house one or more spring mechanisms. For instance, in accordance with certain aspects herein, the first portion 206 and the second portion 208 may include an upper leaf spring 310 and a lower leaf spring 312. The first portion 206 may have an upper spring apex cavity 316 and a lower spring apex cavity 320. The upper spring apex cavity 316 can be located on a first planar inner surface 340 between an upper rail 302 and a first top surface 220. A lower apex spring cavity 320 may be located on the first planar inner surface 340 between a lower rail 304 and a first bottom surface 222. The upper apex spring cavity 316 and the lower apex spring cavity 320 can be substantially parallel to one another and span horizontally along at least a portion of the first planar inner surface 340.

The height of the upper apex spring cavity 316 can be sufficient to allow the upper leaf spring 310 to be partially disposed therein and the height of the lower apex spring cavity 320 can be sufficient to allow the lower leaf spring 312 to be partially disposed therein. The width of the upper apex spring cavity 316 and the width of the lower apex spring cavity 320 can be less than the overall width of the first portion 206. Further, the depth of the upper apex spring cavity 316 can correspond to the properties of the upper leaf spring 310 and the depth of the lower apex spring cavity 320 can correspond to the properties of the lower leaf spring 312. The depth of the upper apex spring cavity 316 can allow the apex of the upper leaf spring 310 to be at least partially disposed within the upper apex spring cavity 316 when in the opened position and the depth of the lower apex spring cavity 320 can allow the apex of the lower leaf spring 312 to be at least partially disposed within the lower apex spring cavity 320 when in the opened position.

The second portion 208 may have an upper spring base cavity 314 and a lower spring base cavity 318. The upper spring base cavity 314 can be located on a second planar inner surface 342 between an upper lock channel 306 and a second top surface 226. The lower spring base cavity 318 may be located on the second planar inner surface 342 between a lower lock channel 308 and a second bottom surface 224. The upper spring base cavity 314 and the lower spring base cavity 318 can be substantially parallel to one another and span horizontally along at least a portion of the second planar inner surface 342.

The height of the upper spring base cavity 314 can be sufficient to allow the upper leaf spring 310 to be at least partially disposed therein and the height of the lower spring base cavity 318 can be sufficient to allow the lower leaf spring 312 to be at least partially disposed therein. The width of the upper spring base cavity 314 and the lower spring base cavity 318 can be less than the overall width of the second portion 208. Further, the depth of the upper spring base cavity 314 can correspond to the properties of the upper leaf spring 310, allowing the bases of the upper leaf spring 310 to be at least partially contained within the upper spring base cavity 314 when in the opened position. Similarly, the depth of the lower spring base cavity 318 can correspond to the properties of the lower leaf spring 312, allowing the bases of the lower leaf spring 312 to be at least partially contained within the lower spring base cavity 318 when in the opened position.

When the first portion 206 and the second portion 208 are coupled together as illustrated in the standalone assembly of FIG. 2, the upper spring apex cavity 316 is aligned with the upper spring base cavity 314 to form a space for housing the upper leaf spring 310 therein. Further, the lower spring apex cavity 320 aligns with the lower spring base cavity 318 to form a space for housing the lower leaf spring 312 therein. The upper leaf spring 310 may remain in substantial contact with the upper spring apex cavity 316 and the back wall (not shown) of the upper spring base cavity 314 while the lower leaf spring 312 may remain in substantial contact with the lower spring apex cavity 320 and the back wall (not shown) of the lower spring base cavity 318. The upper leaf spring 310 and the lower leaf spring 312 may exert a force on the spring cavity back walls sufficient to keep the two sides in the opened position.

While this particular embodiment utilizes leaf springs, one skilled in the art can understand how a plurality of springing mechanisms and cavities could be substituted to achieve the intended function of the present teachings. This disclosure should be considered to incorporate a plurality of springing mechanisms such as a cantilever spring, a coil spring, a spring washer and the like to achieve the desired function disclosed herein. Further, the spring system described herein could be substituted by a plurality of materials that have unique elastic properties to achieve a substantially similar result. One skilled in the art can recognize that many rubber, plastic, or metallic materials can have the necessary elastic properties to be utilized in place of the spring system disclosed above.

The first portion 206 may contain an upper rail 302 and a lower rail 304. In accordance with certain aspects of the present disclosure, the upper rail 302 and the lower rail 304 can protrude perpendicularly from the first planar inner surface 340, and may run parallel to one another. The upper rail 302 may be located between the upper spring apex cavity 316 and the first semicircular channel 344. Further, the lower rail 304 may be located between the lower spring apex cavity 320 and the first semicircular channel 344. The upper rail 302 and the lower rail 304 can be substantially centered horizontally and extend along the first planar inner surface 340 a distance that is slightly less than the overall width of the first portion 206.

Figure 3B:
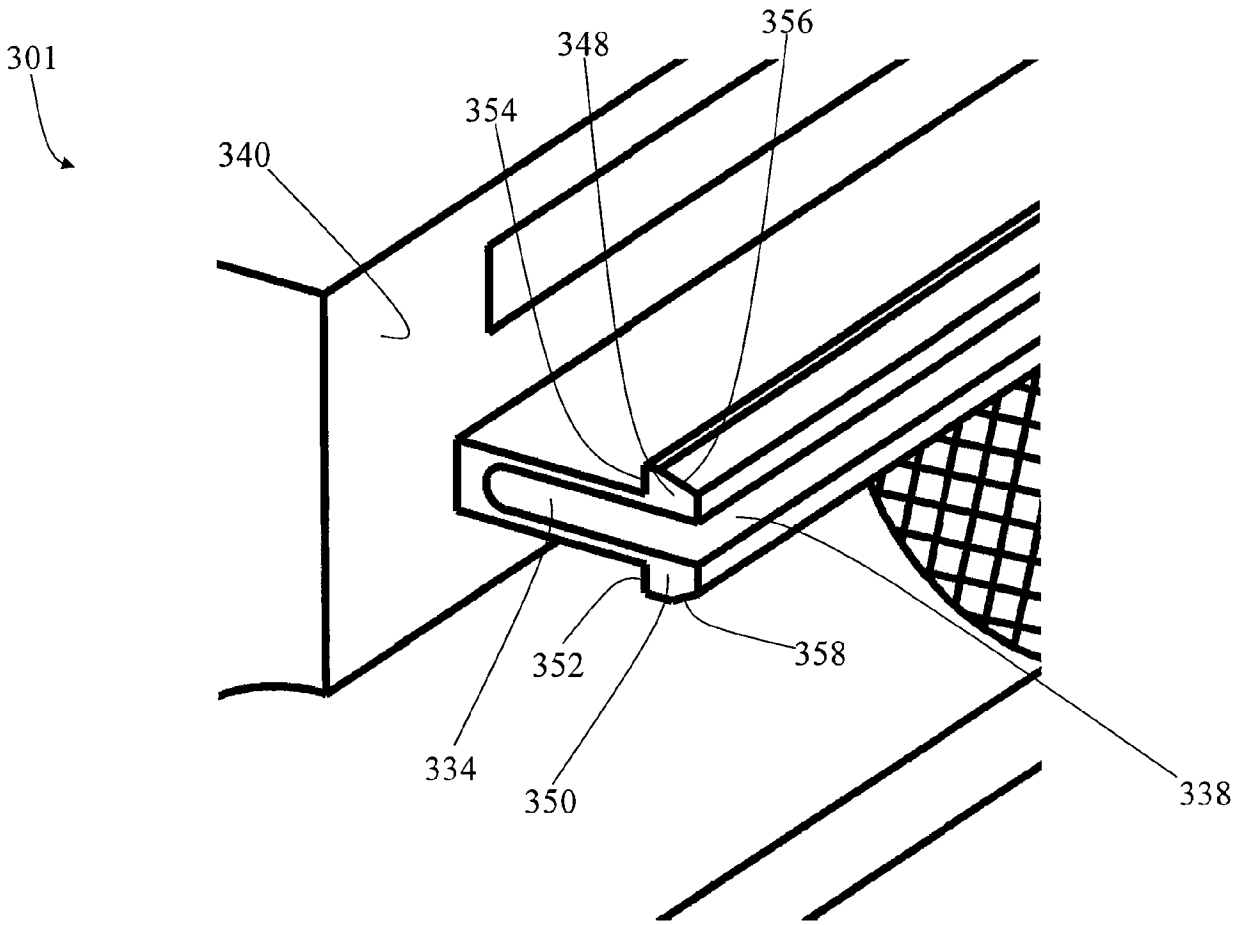
FIG. 3B represents a close-up and partial perspective view of a portion of the illustrative igniter apparatus of FIG. 3A.

The upper rail 302 and the lower rail 304 can include a compressible head 338 located on a semi-hollowed wall 334 extruded from the first planar inner surface 340. The partial detailed view 301 of FIG. 3B further illustrates how the compressible head 338 can have an upper wedge-shaped portion 348 and a lower wedge-shaped portion 350 located on the outward portion of the semi-hollowed wall 334. The upper wedge-shaped portion 348 can have an upper inner lip 354 that is substantially parallel to the first planar inner surface 340. Similarly, the lower wedge-shaped portion 350 can have a lower inner lip 352 that is substantially parallel to the first planar inner surface 340.

The upper wedge-shaped portion 348 can have an upper angled contact edge 356. The upper angled contact edge 356 can extend from the inner lip 354 and angle inwardly towards the semi-hollowed wall 334 as the upper angled contact edge 356 is also extended outwardly towards the end of the compressible head 338. Similarly, the lower angled contact edge 358 can extend from the lower inner lip portion 352 and angle inwardly towards the semi-hollowed wall 334 as the lower angled contact edge 358 is also extended outwardly towards the end of the compressible head 338. The semi-hollowed wall 334 may have a sufficient gap therein to allow the upper wedge-shaped portions 348 and the lower wedge-shaped portion 350 to be deflected inwardly as a corresponding force is applied to the upper angled contact edge 356 and the lower angled contact edge 358.

FIG. 3A further illustrates how the second portion 208 may contain an upper lock channel 306 that corresponds with an upper rail 302 and a lower lock channel 308 that corresponds with a lower rail 304. The upper lock channel 306 and the lower lock channel 308 may be substantially parallel to each other. The upper lock channel 306 can be positioned between the upper spring base cavity 314 and the second semicircular channel 346. The lower lock channel 308 can be positioned between the lower spring base cavity 318 and the second semicircular channel 346. Further, the upper lock channel 306 and the lower lock channel 308 can have a sufficient opening to allow the upper rail 302 and the lower rail 304 to fit respectively therein. Specifically, the channels may allow the upper rail 302 to be removably coupled to the upper lock channel 306 while the lower rail 304 may be removably coupled to the lower lock channel 308.

Figure 4A:
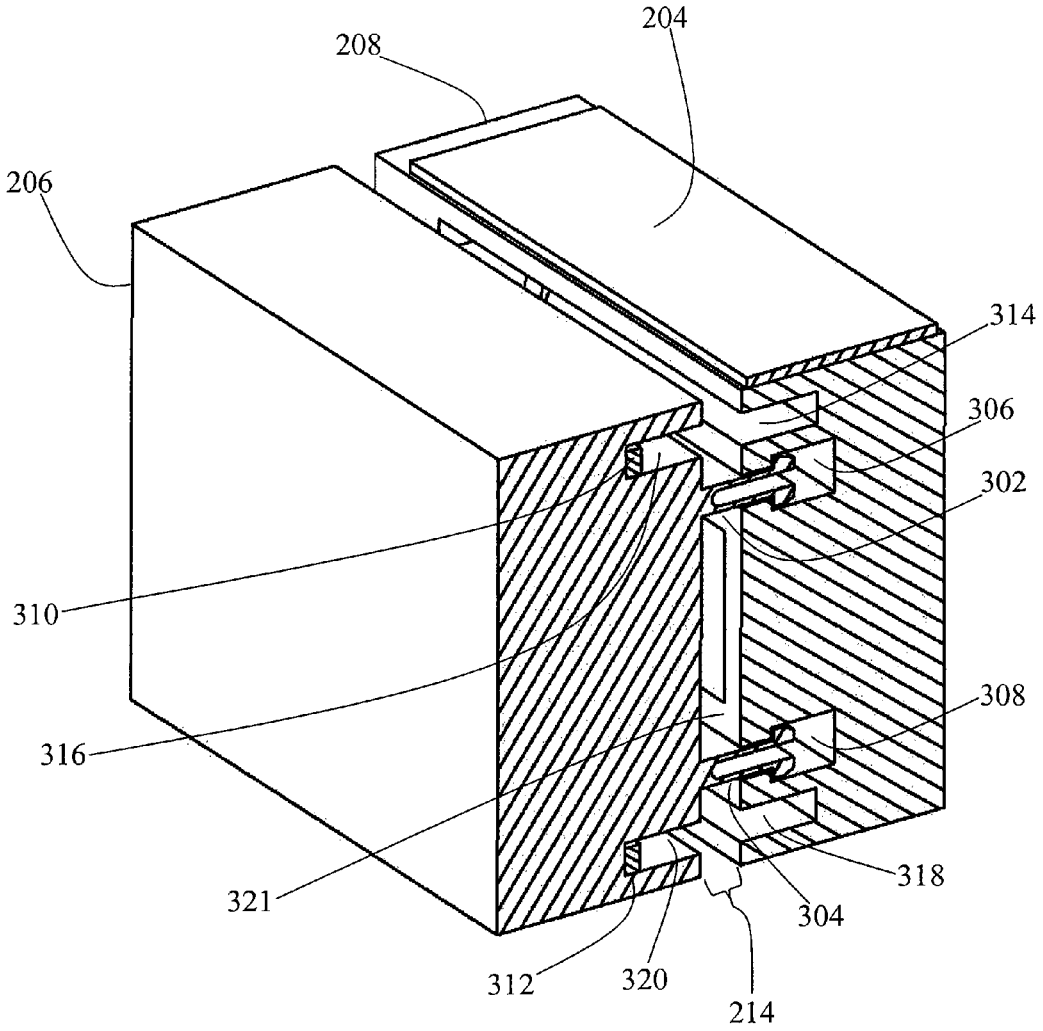
FIG. 4A represents a partial section view of the illustrative igniter apparatus of FIG. 1 in the open orientation.
Figure 4B:
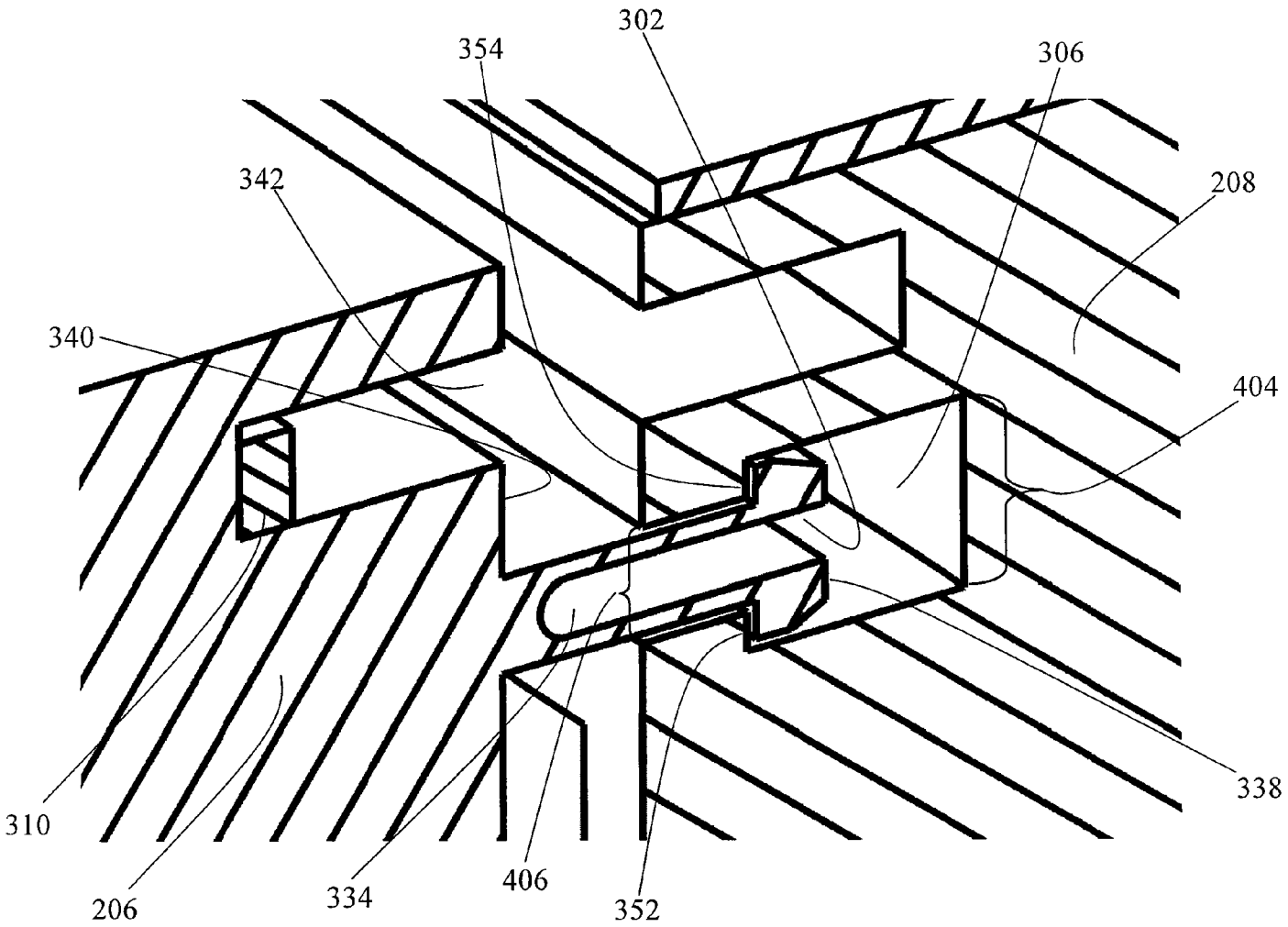
FIG. 4B represents a close-up and partial perspective view of a portion of the illustrative igniter apparatus of FIG. 4A.

FIG. 4A illustrates a cross-sectional view of the igniter apparatus 102. The cross-sectional view shows the igniter apparatus 102 in the expanded position. Further, the partial detailed view of FIG. 4B illustrates how the upper rail 302 is removably coupled to the upper lock channel 306. The upper lock channel 306 can have a minimum slot width 406 on the second planar inner surface 342 which may be followed by an increased slot width 404. The minimum slot width 406 may be sufficiently wide to allow the compressible head 338 of the upper rail 302 to be forcibly inserted through the minimum slot width 406 and into the increased slot width 404. Further the semi-hollowed wall 334 may have a thickness slightly less than the minimum slot width 406 to allow the semi-hollowed wall 334 to slide therein.

The compressible head 338 may prevent the upper rail 302 from being removed from the upper lock channel 306. Once the compressible head 338 is pressed through the minimum slot width 406, the compressible head 338 can enter the increased slot width 404. Once the compressible head 338 enters the increased slot width 404, the upper lip portion 354 and the lower lip portion 352 may become oppositely aligned with the lip (not shown) between the minimum slot width 406 and the increased slot width 404. The upper lip portion 354 and the lower lip portion 352 can act as stops to prevent the first portion 206 from being pulled away from the second portion 208 farther than desired. Further, the distance between the upper lip portion 354 and the lower lip portion 352 from the first planar inner surface 340 is used to control the width of the gap 214 between the first portion 206 and the second portion 208.

FIG. 4A further shows how the width of the gap 214 can be maintained by the upper leaf spring 310 and the lower leaf spring 312. The upper leaf spring 310 and the lower leaf spring 312 may exert a force pushing the first portion 206 and the second portion 208 apart from one another. As shown in FIG. 4B, the opposing force caused by the upper leaf spring 310 and the lower leaf spring 312 may be resisted when the upper inner lip portion 352 and the lower inner lip portion 354 of the compressible head 338 on the upper rail 302 and the lower rail 304 come into contact with the lip between the minimum slot width 406 and the increased slot width 404 of the upper lock channel 306 and the lower lock channel 308. Therefore, the gap 214 between the first portion 206 and the second portion 208 may be maintained by the upper leaf spring 310 and the lower leaf spring 312 when no external forces are applied to the igniter apparatus 102.

Figure 5A:
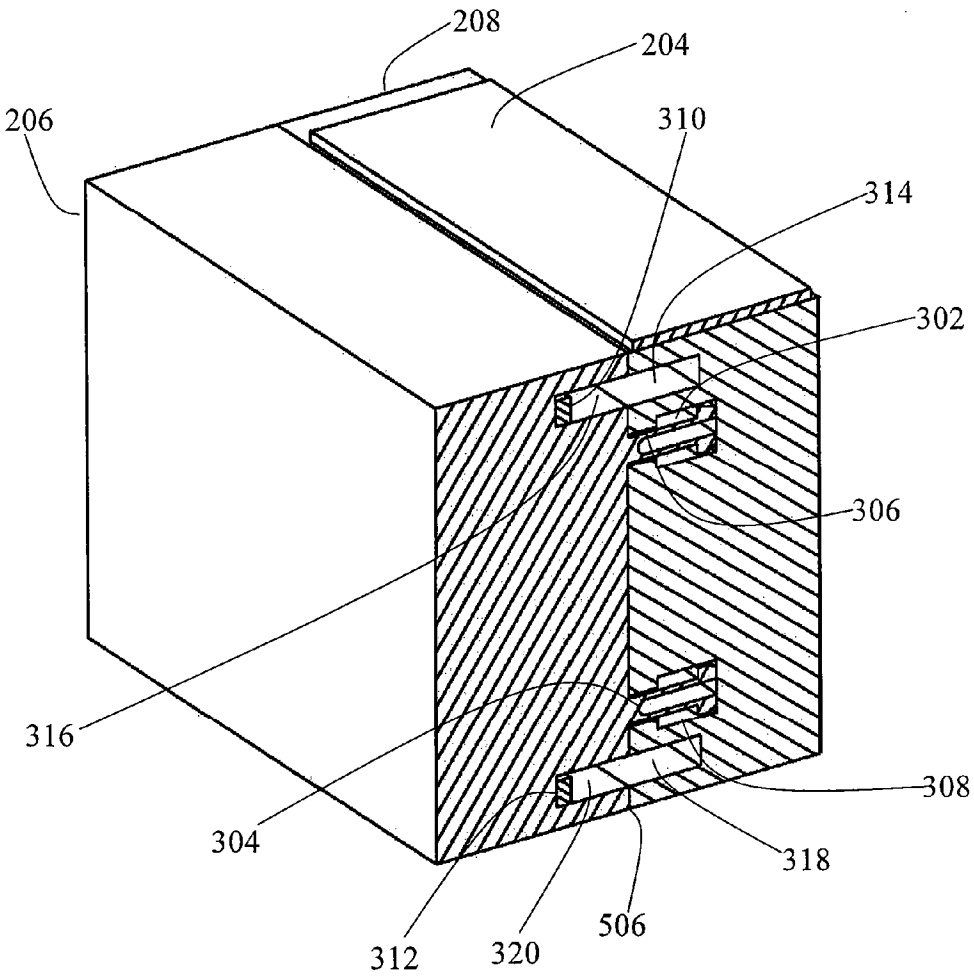
FIG. 5A represents a partial section view of the illustrative igniter apparatus of FIG. 1 in the closed orientation.
Figure 5B:
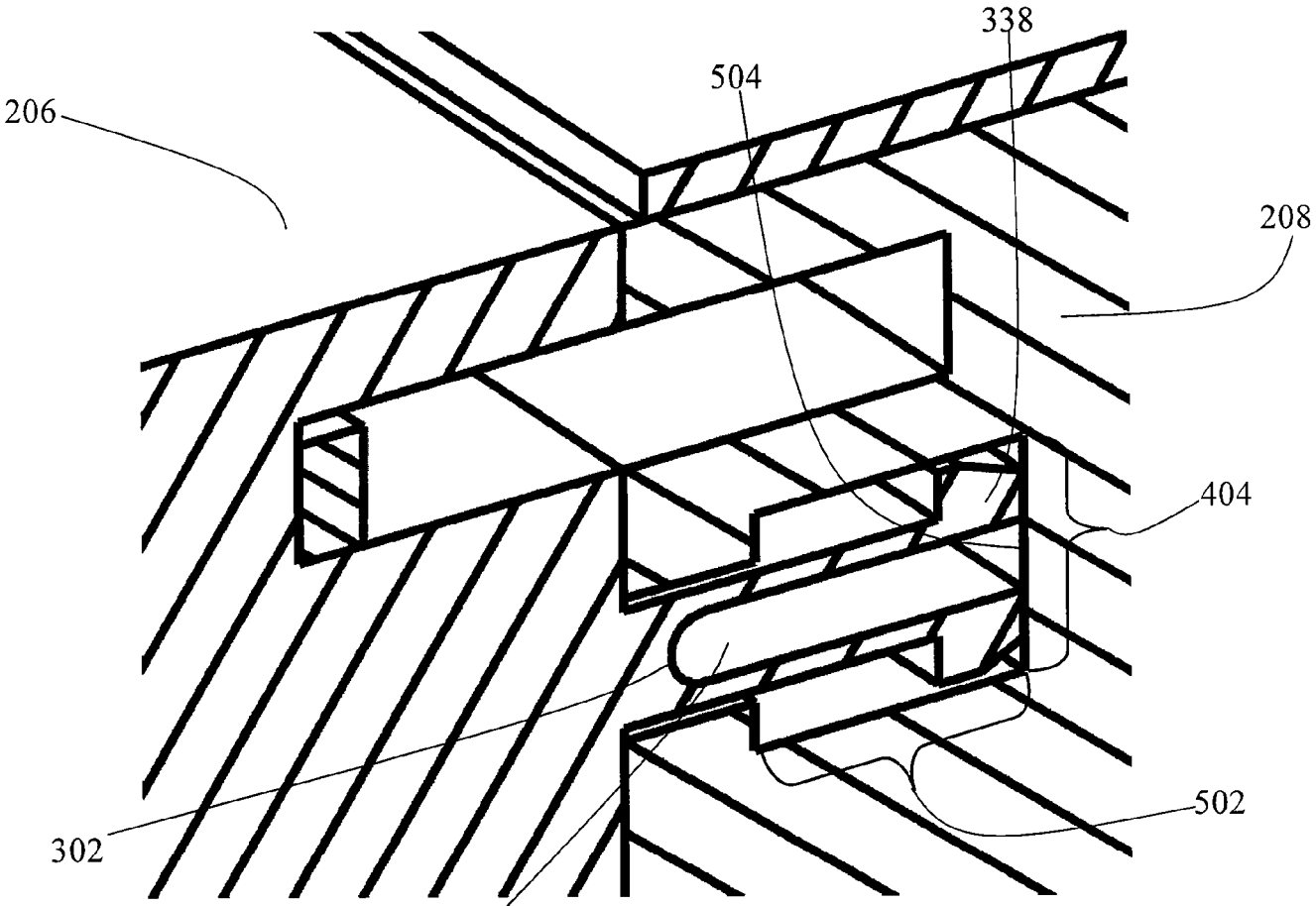
FIG. 5B represents a close-up and partial perspective view of a portion of the illustrative igniter apparatus of FIG. 5A.

FIG. 5A illustrates a cross sectional view with the first portion 206 and the second portion 208 in a closed position. Further, FIG. 5B shows how the increased gap opening 404 can have a sufficient gap depth 502 to allow the first planar inner surface 340 and the second planar inner surface 342 to substantially contact one another when external forces are applied to draw the first portion 206 and the second portion 208 together. The gap depth 502 may be dependent on the length of the semi-hollowed wall 334 for the upper rail 302 and the lower rail 304. The gap depth 502 can be sufficient to allow the first planar inner surface 340 and the second planar inner surface 342 to come into substantial contact before or while the compressible head 338 contacts a lock channel back wall 504. While no specific detailed description of the lower rail 304 and lower lock channel 308 relationship is disclosed, one skilled in the art can understand how the disclosure regarding the upper rail 302 and the relationship with the upper lock channel 306 can be incorporated and the substantially similar methods may be used for the lower rail 304 and lower lock channel 308.

Figure 6:
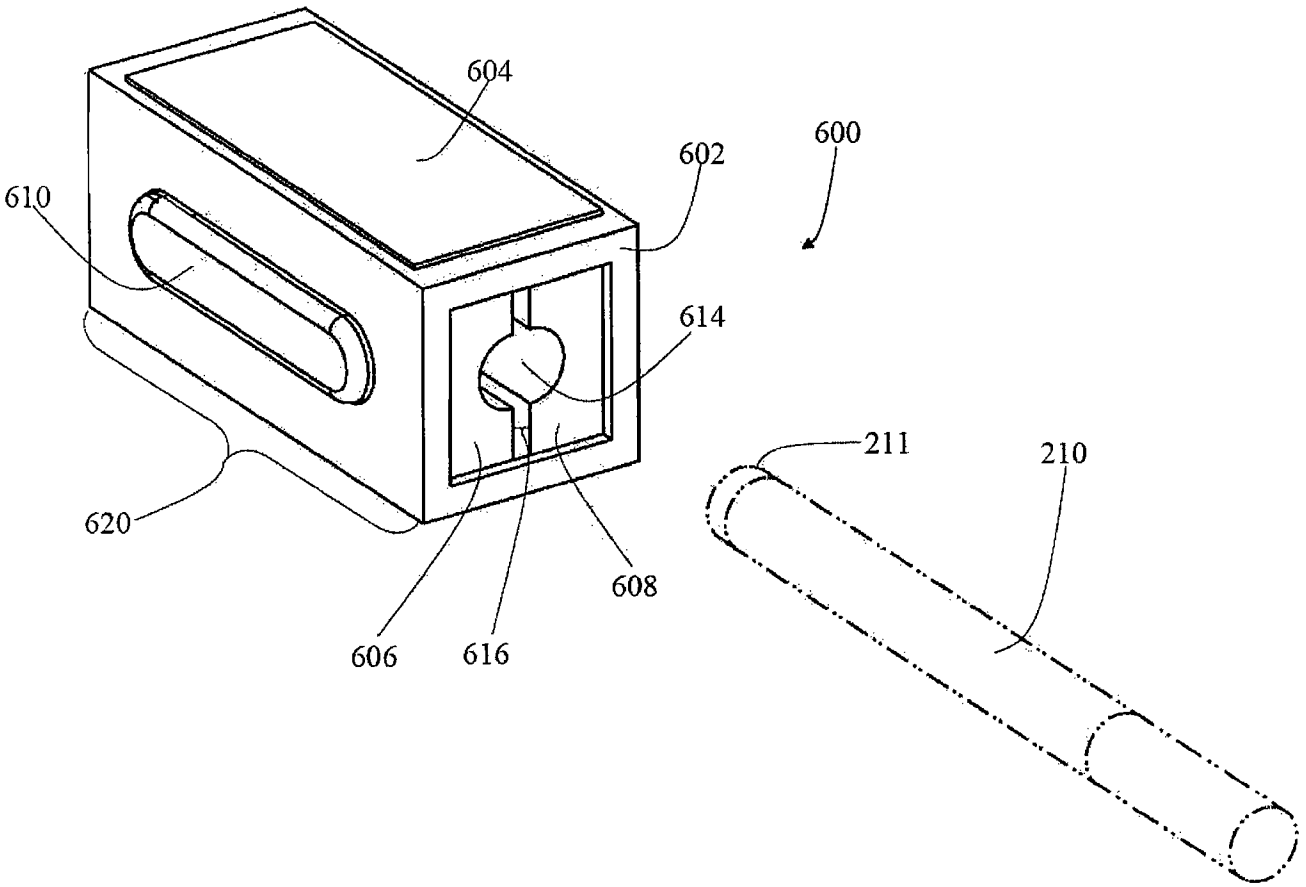
FIG. 6 represents a perspective view of another illustrative igniter apparatus housed in an exterior frame while in the open orientation in accordance with the teachings of the present disclosure.

FIG. 6 illustrates an alternative embodiment in accordance with the present disclosure in which an igniter apparatus is configure within an in-frame embodiment 600. In this particular embodiment, an external frame 602 may be used to contain the first portion 606 and second portion 608. The external frame 602 can perform a substantially similar function as the rails (302 and 304 of FIG. 3) and the lock channels (306 and 308 of FIG. 3) while acting as a platform for an adhesive strip 604. The frame 602 can create a chamber that allows the first portion 606 and the second portion 608 to be disposed therein. A button 610 may be coupled to the first portion 606 and be accessible through a cutout 611 of the frame 602. Further, the frame 602 can substantially restrict the first portion 606 and the second portion 608 from moving in any direction other than directly towards or away from one another.

Figure 7:
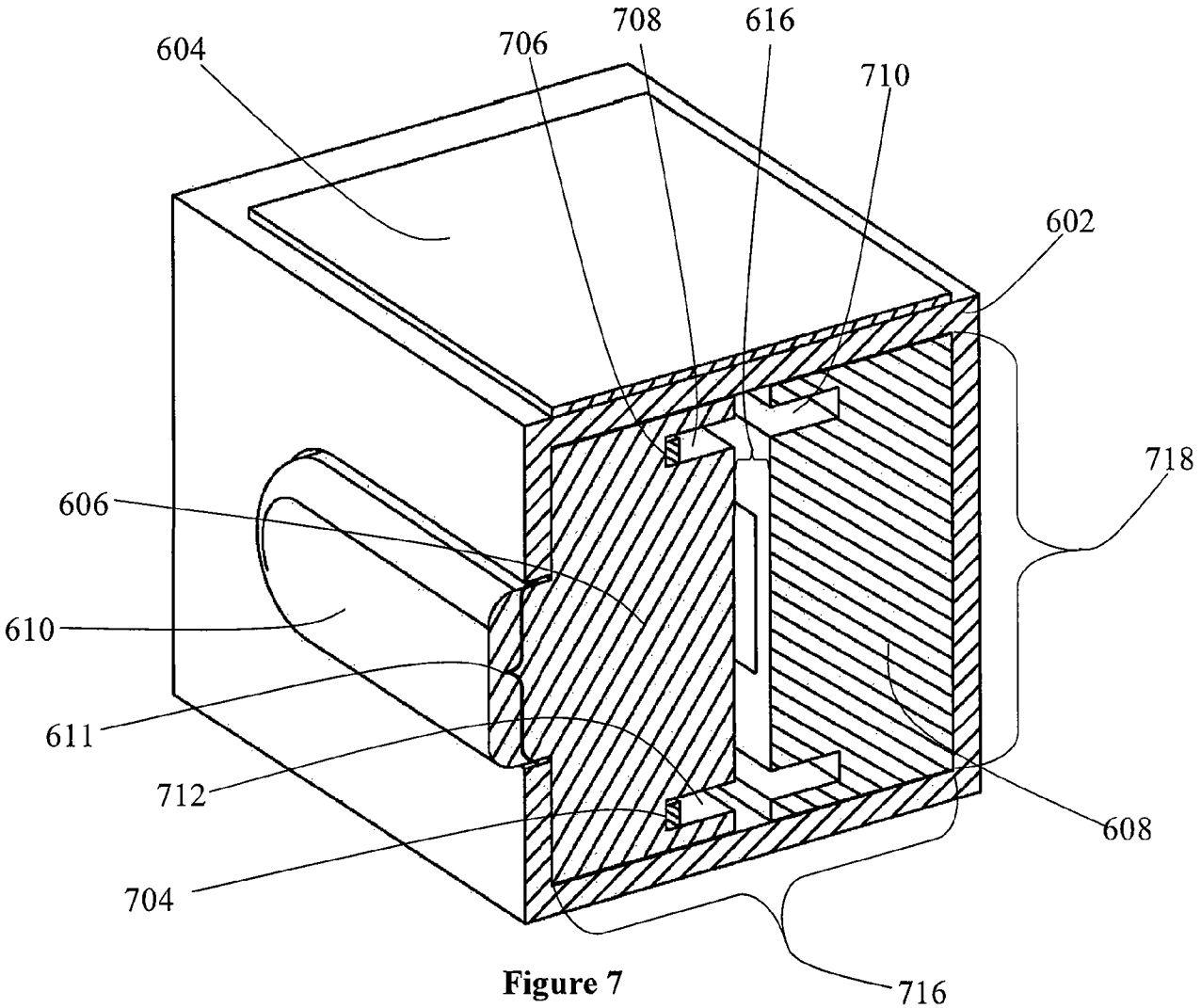
FIG. 7 represents a partial section view of the illustrative igniter apparatus of FIG. 6.

FIG. 7 shows a cross sectional view of the in-frame assembly 600. The button 610 may be incorporated into the first portion 606 and a cutout 611 in the frame 602 may allow access to the button 610. The button 610 can be at a location that allows an external force to be applied to the first portion 606. When an external force is applied to the button 610, the first portion 606 and the second portion 608 may be drawn together. While this particular embodiment illustrates a button on only one half of the assembly, one skilled in the art can understand the many methods that can be adopted in accordance with the present disclosure to achieve a similar result. Such methods as a button on each side, or a gap in the frame allowing access to the inner halves should be considered incorporated herein.

When no external forces are applied to the in-frame embodiment 600, a gap 616 may be maintained between the first portion 606 and the second portion 608. The gap 616 can be substantially maintained by the outward force applied to the first portion 606 and the second portion 608 by an upper leaf spring 706 and a lower leaf spring 704. The upper leaf spring 706 and the lower leaf spring 704 can be respectively located in an upper leaf spring cavity 710 and a lower leaf spring cavity 712. This particular embodiment 600 utilizes a substantially similar application of leaf springs and spring cavities as disclosed in the previous embodiment, and with particular reference to FIGS. 1-5B. Further, the frame 602 can have an inner width 716 that allows for the first portion 606 and the second portion 608 to maintain the gap 616 when no external forces are applied to the in-frame embodiment 600. The inner frame height 718 and inner frame length 620 (FIG. 6) can be dimensioned to be slightly greater than the height and length of the first portion 606 and the second portion 608. The frame 602 is dimensioned to substantially restrict the movement of the first portion 606 and the second portion 608 except in a direction towards or away from one another.

The in-frame embodiment 600 of FIGS. 6 and 7 contains a chamber 614, divider (not shown), and abrasive coating (not shown) similarly as described in the previous embodiment disclosed herein. Further the in-frame embodiment may function in substantially the same way as the previous embodiment.

FIGS. 8A through 8D illustrate how the igniter apparatus 102 can be used to ignite a cigarette 210 with a sensitized tip 211. FIG. 8A illustrates a cigarette 210 with a sensitized tip 211 aligned to the chamber 212 with the igniter apparatus 102 in the expanded position. FIG. 8B illustrates a cigarette 210 with a sensitized tip (not shown) inserted into the igniter apparatus 102 until it contacts the first divider 321 and/or the second divider 322. FIG. 8C illustrates the igniter apparatus 102 in the closed position, allowing the cigarette 210 with a sensitized tip (not shown) to be in substantial contact with the abrasive coatings 324 and 325 in the chamber (not shown). FIG. 8D illustrates a lit cigarette 210 after it has been forcibly removed from a compressed chamber 212, allowing the abrasive coatings 324 and 325 to ignite the sensitized tip (not shown).

While an exemplary embodiment incorporating the principles of the present application has been disclosed hereinabove, the present application is not limited to the disclosed embodiments. Instead, this application is intended to cover any variations, uses, or adaptations of the application using its general principles. Further, this application is intended to cover such departures from the present disclosure as come within known or customary practice in the art to which this present application pertains and which fall within the limits of the appended claims.

The terminology used herein is for the purpose of describing particular illustrative embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations).

The invention claimed is:

1. An igniter apparatus for igniting a tobacco-based product having a sensitized tip, comprising:

a first portion having a first surface and a second portion having a second surface, at least one of the first and second surfaces being movable with respect to the other surface between an opened orientation and a closed orientation, wherein at least a portion of the first and second surfaces are substantially parallel to one another in both the opened and closed orientation;

a substantially cylindrical channel at least partially formed between the first and second portions when the first and second surfaces are in the closed orientation, the cylindrical channel having at least one opening configured to receive the tobacco-based product as it is inserted therein;

an abrasive material coated on at least a portion of the cylindrical channel, wherein the abrasive material is configured to at least partially contact the tobacco-based product when the first and second surfaces are in the closed orientation and wherein the abrasive material does not substantially contact the tobacco based product when the first and second surfaces are in the opened orientation;

at least one spring apex cavity defined in the first portion and at least one spring base cavity defined in the second portion;

at least one spring positioned partially in the spring apex cavity and partially in the spring base cavity; and at least one rail extending from the first surface and at least one lock channel defined in the second portion;

wherein the rail is slidably coupled to the lock channel to define a maximum gap distance between the first surface and the second surface when in the opened orientation.

2. The igniter apparatus of claim 1, wherein the cylindrical channel has a maximum width when the first and second surfaces are separated the maximum gap distance from one another and a minimum width when the first and second surfaces are separated a minimum gap distance from one another.

3. The igniter apparatus of claim 2, wherein the abrasive material is configured to at least partially contact the tobacco-based product when the first and second surfaces are separated the minimum gap distance from one another.

4. The igniter apparatus of claim 3, wherein the abrasive material is configured to at least partially contact a sensitized tip of the tobacco-based product when the first and second surfaces are separated the minimum gap distance from one another.

5. The igniter apparatus of claim 1, wherein the at least one spring produces a biasing force against the spring apex cavity and the spring base cavity that is configured to directionally bias the first portion away from the second portion.

6. The igniter apparatus of claim 5, wherein the at least one spring is a leaf spring.

7. The igniter apparatus of claim 5, wherein the biasing force of the at least one spring is capable of being manually overcome by directionally forcing the first portion towards the second portion.

8. The igniter apparatus of claim 1, wherein the cylindrical channel comprises a first cylindrical section and a second cylindrical section, the first and second cylindrical sections being substantially coaxial with one another and separated by a stop surface positioned within the cylindrical channel.

9. The igniter apparatus of claim 8, wherein at least a portion of the abrasive material is coated on the stop surface.

10. The igniter apparatus of claim 1, further comprising an adhesive material configured to releasably couple the igniter apparatus to a container.

11. The igniter apparatus of claim 1, further comprising a button, the button being manually actuatable in order to move at least one of the first and second surfaces with respect to the other surface.

12. A kit, comprising:

a tobacco-based product having a sensitized tip;

a container for holding the tobacco-based product therein; and an igniter apparatus configured to ignite the sensitized tip of the tobacco-based product, the igniter apparatus comprising:

a first portion having a first surface and a second portion having a second surface, at least one of the first and second surfaces being movable with respect to the other surface between an opened orientation and a closed orientation, wherein at least a portion of the first and second surfaces are substantially parallel to one another in both the opened and closed orientation;

a substantially cylindrical channel at least partially formed between the first and second portions when the first and second surfaces are in the closed orientation, the cylindrical channel having at least one opening configured to receive the sensitized tip of the tobacco-based product as it is inserted therein; and an abrasive material coated on at least a portion of the cylindrical channel, wherein the abrasive material is configured to at least partially contact the tobacco-based product when the first and second surfaces are in the closed orientation and wherein the abrasive material does not substantially contact the tobacco based product when the first and second surfaces are in the opened orientation;

at least one spring apex cavity defined in the first portion and at least one spring base cavity defined in the second portion;

at least one spring positioned partially in the spring apex cavity and partially in the spring base cavity; and at least one rail extending from the first surface and at least one lock channel defined in the second portion;

wherein the rail is slidably coupled to the lock channel to define a maximum gap distance between the first surface and the second surface when in the opened orientation;

further wherein, the igniter apparatus is removeably coupled to the container to allow the igniter apparatus to transition between the opened orientation and the closed orientation.

13. The kit of claim 12, wherein the at least one spring is a leaf spring having a biasing force that is configured to directionally bias the first portion away from the second portion.

14. The kit of claim 12, wherein the cylindrical channel comprises a first cylindrical section and a second cylindrical section;

further wherein the first cylindrical section and the second cylindrical section are substantially coaxial with one another and separated by a stop surface positioned within the cylindrical channel.

15. The kit of claim 14, wherein the stop surface of the igniter apparatus is at least partially coated with the abrasive material.

16. The kit of claim 12, wherein the igniter apparatus further comprises an adhesive material configured to releasably couple the igniter apparatus to the container.

17. The igniter apparatus of claim 1, wherein the rail is comprised of a semi-hollowed wall extending from the first surface to a compressible head located distally along the rail, the compressible head further comprising an inner lip that is substantially parallel with the first surface.

18. The igniter apparatus of claim 17, wherein the lock channel defines a lock channel lip; and wherein the inner lip is configured to contact the lock channel lip to define the maximum gap distance when the compressible head is disposed within the lock channel.

19. The kit of claim 12, wherein the igniter apparatus is coupled to the container along a bottom surface.

20. The kit of claim 16, wherein the adhesive material is coupled to one of the first portion or the second portion.

* * * * *